US006419477B1

(12) United States Patent
Robinson

(10) Patent No.: US 6,419,477 B1
(45) Date of Patent: Jul. 16, 2002

(54) METHOD FOR IMPROVING FUEL EFFICIENCY IN COMBUSTION CHAMBERS

(76) Inventor: Barnett Joel Robinson, 227 California St., Newton, MA (US) 02458

( * ) Notice: Subject to any disclaimer, the term of this patent is extended or adjusted under 35 U.S.C. 154(b) by 0 days.

(21) Appl. No.: 09/672,890

(22) Filed: Sep. 28, 2000

(51) Int. Cl.[7] ..... C10L 3/00
(52) U.S. Cl. ..... 431/4; 44/354; 44/603
(58) Field of Search ..... 431/4, 12; 44/354, 44/603

(56) References Cited

U.S. PATENT DOCUMENTS 5,085,841 A 2/1992 Robinson
5,823,758 A * 10/1998 Lack ..... 431/4
6,176,701 B1 * 1/2001 Robinson ..... 431/4
6,206,685 B1 * 3/2001 Zamansky et al. ..... 431/4

* cited by examiner

*Primary Examiner*—Sara Clarke
(74) *Attorney, Agent, or Firm*—David M. Warren

(57) ABSTRACT

A method of improving fuel efficiency in combustion chambers, for simultaneously enhancing combustion of hydrocarbon fuels while inhibiting nitrogen oxidation. A mixture of vaporous metallic compounds is introduced into the flame zone of a combustion chamber, such that this mixture is held by gases in the flame zone prior to and during the combustion of the fuel, and the mixture is thereby ionized prior to or during the combustion. The ionized mixture of compounds contains platinum, rhodium, rhenium, molybdenum, aluminum and ruthenium.

11 Claims, No Drawings

METHOD FOR IMPROVING FUEL EFFICIENCY IN COMBUSTION CHAMBERS

FIELD OF THE INVENTION

The present invention generally relates to a method of improving fuel efficiency in combustion chambers. More specifically, the present invention relates to a method of improving fuel efficiency in combustion chambers (by enhancing carbon or hydrogen combustion while simultaneously inhibiting nitrogen oxidation), comprising introducing a mixture of metallic compounds into the flame zone of a combustion chamber substantially homogeneously, such that the mixture is held by gases in the flame zone during the combustion of the fuel, and the mixture is thereby ionized prior to or during the combustion. This ionized mixture of compounds contains platinum, rhodium, rhenium, molybdenum, aluminum and ruthenium.

BACKGROUND OF THE INVENTION

The burning of almost all hydrocarbon fuels in their respective combustion chambers is almost never complete. It is the unburned fuel leaving the combustion chamber which pollutes the atmosphere. The unburned fuel includes hydrocarbons, soot, smoke, carbon monoxide (CO), and oxides of nitrogen ($NO_x$). The unburned and partially burned fuel represent both the pollution from the combustion process and a financial loss to the purchaser of the fuel. The only pollutant from a combustion process which is not unburned or partially burned fuel is nitrogen oxide. However, since the oxidation of the nitrogen to form nitrogen oxide is endothermic, the inhibiting of the oxidation of nitrogen is also equivalent to the burning of less fuel.

A second problem related to actual combustion chambers, such as in automotive engines or in oil fired boilers, is that these chambers have a wide distribution of parametric variation. This has been experimentally verified (by the inventor of the method of the present invention) by measuring the fuel combustion efficiency of new automobiles of the same model and of almost identical dates of manufacture.

Effective methods for simultaneously enhancing fuel oxidation and inhibiting nitrogen oxidation are known (i.e. 1992 U.S. Pat. No. 5,085,841—by the inventor of the present invention). However, because of the parametric variations of actual engines, these methods often fail to provide beneficial results in a percentage of individual engines. The method of the present invention is a substantial improvement over the prior arts, in that all individual engines measured have shown significant improvements of increased carbon oxidation and of decreased nitrogen oxidation.

SUMMARY OF THE INVENTION

The present invention relates to a method of improving fuel efficiency in combustion chambers by simultaneously enhancing the combustion of carbon and hydrogen while inhibiting the oxidation of nitrogen. It is believed that the invention is operative by catalyzing the oxidation of hydrogen, carbon, and carbon monoxide which are present during the combustion of typical hydrocarbon fuels, while simultaneously inhibiting the oxidation of nitrogen. This method is comprised of introducing a vaporous mixture of metallic compounds into the flame zone of a combustion chamber substantially homogeneously, such that the mixture is held by gases in the flame zone prior to and during the combustion of the fuel, and the mixture is thereby ionized prior to or during the combustion. The ionized mixture of compounds according to the present invention contains platinum, rhodium, rhenium, molybdenum, aluminum and ruthenium.

DETAILED DESCRIPTION OF THE INVENTION

For the purpose of the present invention, a "fuel" is any substance which is exothermically oxidized in a combustion chamber. Furthermore, a fuel generally relates to compounds of carbon and/or compounds of hydrogen, as well as to carbon and hydrogen themselves.

For purposes of the present invention. "metallic compounds" relate to compounds containing constituent metals which ionize under the physical conditions (e.g. pressure, temperature) found in combustion chambers during the fuel combustion process. For purposes of the present invention, there are many practical compounds of respective ones of the foregoing metals which contribute to providing the desired results when introduced into a combustion chamber. Examples of such compounds may typically be chosen from the chlorides, oxides, hydroxides, and hydrates of the metals platinum, rhodium, rhenium, molybdenum, aluminum and ruthenium.

The present invention relates to a method of improving fuel efficiency in combustion chambers, for simultaneously enhancing fuel (carbon, carbon monoxide or hydrogen) combustion while inhibiting nitrogen oxidation. This method is comprised of introducing a mixture of vaporous metallic compounds into the flame zone of a combustion chamber (so that these compounds are distributed within the combustion chamber) substantially homogeneously, such that the mixture is held by gases in the flame zone prior to and during the combustion of the fuel, and the mixture is thereby ionized prior to or during the combustion. The ionized mixture of compounds contains platinum, rhodium, rhenium, molybdenum, aluminum and ruthenium.

According to one embodiment of the method of the present invention, the mixture of compounds contains, per kilogram of fuel, from 0.15 to 225 mcg (micrograms) platinum, from 0.045 to 67.5 mcg rhodium, from 0.07 to 105.0 mcg rhenium, from 0.116 to 174.0 mcg molybdenum, 0.15 to 225 mcg aluminum, and from 0.045 to 67.5 mcg ruthenium.

According to the preferred embodiment of the method of the present invention, the mixture of compounds contains about 15 mcg platinum, about 4 mcg rhodium, about 7 mcg rhenium, about 11 mcg molybdenum, about 15 mcg aluminum and about 4 mcg ruthenium per kilogram of fuel. Near optimum combustion benefits are obtained within the range of about 10–20 mcg platinum, about 3–6 mcg rhodium, about 4–10 mcg rhenium, about 7–16 mcg molybdenum, about 10–20 mcg aluminum and about 4–10 mcg ruthenium per kilogram of fuel. Good benefits are obtained even within the larger range of about 8–24 mcg platinum, about 2–8 mcg rhodium, about 3–10 meg rhenium, about 6–18 mcg molybdenum, about 8–24 mcg aluminum and about 2–8 mcg ruthenium per kilogram of fuel.

By way of alternative embodiments of the invention, it is noted that improved benefits are obtained even if only one of the aluminum or the ruthenium are added to the mixture of the four metal catalysts (platinum, rhodium, rhenium, and molybdenum) but still greater benefits are obtained upon addition of both the aluminum and the ruthenium to the mixture of the four metal catalysts (platinum, rhodium, rhenium, and molybdenum).

According to the preferred embodiment of the method of the present invention, the following compounds of the foregoing metals are preferred in the practice of the invention, each of these compounds being soluble in water, as well as being ionizable in the flame of combustion. According to the preferred embodiment of the method of the present invention, the molybdenum compound is hexaamoniumheptamolybdate tetrahydrate ($(NH_4)_6Mo_7O_{24}.4H_2O$). This compound is commonly called "AHM". The aluminum compound is aluminum trichloride sexahydrate ($AlCl_3.6H_2O$), and the ruthenium compound is ruthenium trichloride trihydrate ($RuCl_3.3H_2O$). The platinum compound is dihydrogenplatinum hexachloride sexahydrate ($H_2PtCl_6.6H_2O$); a chloride ($RdCl_2$) of rhodium is employed; and rhenium in perrhenic acid is employed as is disclosed in U.S. Pat. No. 5,085,841 of B. J. Robinson.

The mixture of metallic compounds (or any component thereof) is introduced into the combustion chamber through one or more pathways. According to the preferred embodiment of the method of the present invention, the mixture of compounds is introduced into the combustion chamber by air flow. According to other embodiments of the method of the present invention the mixture of compounds is introduced into the combustion chamber by a stream of fuel, or the mixture of compounds is introduced into the combustion chamber by a vaporous mixture of fuel and air. Furthermore, according to other variations of the method of the present invention, the components of the mixture of compounds may be introduced into the combustion chamber by using more than one pathway. For example, the six components (of the mixture of compounds) may be divided such that two of the components, such as the aluminum and the ruthenium, are introduced through the air flow with the other four components being introduced with an air-fuel mixture.

According to various embodiments of the method of the present invention, whereby the mixture of compounds is introduced into the combustion chamber, the actual concentration of the metallic compounds differ among the various embodiments but, preferably, for efficient use of the catalysts, the mass ratio of the various metals is in accordance with the formulation wherein there are about 15 parts platinum, about 4 to 5 parts rhodium, about 7 parts rhenium, about 12 parts molybdenum, about 15 parts aluminum and about 4 parts ruthenium, per kilogram of fuel, in the chamber during a combustion of fuel in the chamber.

The present invention will be further described and clarified in detail by the following Table. This Table is intended solely to illustrate the preferred embodiment of the invention and is not intended to limit the scope of the invention in any manner. The Table presents data for a gasoline powered engine driving an electric generator. For ease of reference, the combination of the engine and the generator is referred to, in the Table, as a gasoline generator.

TABLE

| Engine Load | Catalyst | Output Volts | HC (PPM) | CO (%) | NO (PPM) | Exhaust Gas Temp. (° F.) |
|---|---|---|---|---|---|---|
| | | Gasoline Generator Manufacturer's. Specs: 800 Watt Peak, 700 Watt Continuous | | | | |
| None | None | 120.1 | 2,500 | 1.00 | 300 | 199 |
| 740 Watts | None | 108.9 | 2,000 | 7.00 | 150 | 210 |
| None | *4 metals | 122.2 | 900 | 2.00 | 50 | 180 |
| 740 Watts | *4 metals | 112.7 | 600 | 4.50 | 0.8 | 165 |
| 740 Watts | **6 metals | 110.8 | 400 | 1.00 | 1.0 | 148 |
| 740 Watts | **6 metals with 50% extra rhodium | 114.1 | 400 | 0.3 | 0.0 | 140 |
| 740 Watts | **6 metals with 50% extra rhenium | 118.8 | 200 | 0.1 | 0.0 | 150 |

*"4 metals" catalyst is the teaching of U.S. patent application 09/483,598 of B. J. Robinson filed 1/14/2000, now U.S. Pat. No. 6,176,701.
**"6 metals" catalyst is the present invention.

Although no quantitative testing has yet been done on diesel engine combustion using the present invention, qualitative observations on diesel combustion using the present invention are significant drops in smell, smoke and noise. The smell, smoke and noise levels appear to the trained human olfactory, eye and ear to be no greater than that produced from an equivalent gasoline engine.

The TABLE shows experimental results comparing the performance and pollution of a Peak 800 watt gasoline generator using no catalyst, the four-metal catalyst of the recent invention and the six-metal catalyst of the present invention under conditions of No-Load and 740 Watt load.

The significance of the improvement between the four-metal catalyst and the six-metal catalyst is expressed in the test data by significant drops in CO and exhaust gas temperatures. These two improvements can only be explained by a much more rapid burning of the fuel to completion. Less time is required for the CO to burn to $CO_2$, therefore, a higher percentage of the CO burns to $CO_2$. The earlier burning of the fuel means more of the produced heat is converted to work and less heat leaves the combustion chamber, therefore, lower exhaust gas temperatures.

The foregoing description is believed to explain the qualitative reduction in smell, smoke and noise when this six-metal catalyst is applied to diesel engines.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

I claim:

1. A method of improving fuel efficiency in combustion chambers for simultaneously enhancing combustion of hydrocarbon fuels while inhibiting nitrogen oxidation comprising introducing a mixture of vaporous metallic compounds via a vaporous transport into the flame zone of a combustion chamber substantially homogeneously, such that said mixture is held by gases in the flame zone before and during the combustion of the fuel, and the mixture is thereby ionized prior to or during said combustion, and the ionized mixture of compounds contains about 15 micrograms of platinum, about 4 to 5 micrograms of rhodium, about 7 micrograms of rhenium, about 11 micrograms of molybdenum, about 15 micrograms of aluminum and about 4 micrograms of ruthenium per kilogram of fuel.

2. The method according to claim 1, wherein the mixture of compounds is introduced into the combustion chamber through the air flow fed into the combustion chamber.

3. The method according to claim 1, wherein the mixture of compounds is introduced into the combustion chamber through a stream of fuel fed into the combustion chamber.

4. The method according to claim 1, wherein the mixture of compounds is introduced into the combustion chamber through a mixture of fuel and air fed into the combustion chamber.

5. The method according to claim 1 wherein said aluminum is a part of an aluminum compound, said aluminum compound is aluminum trichloride sexahydrate ($AlCl_3.6H_2O$).

6. The method according to claim 1 wherein said ruthenium is a part of a ruthenium compound, said ruthenium compound is ruthenium trichloride trihydrate ($RuCl_3.3H_2O$).

7. A method of improving fuel efficiency in combustion chambers for simultaneously enhancing combustion of hydrocarbon fuels while inhibiting nitrogen oxidation comprising introducing a mixture of metallic compounds via a vaporous transport into the flame zone of a combustion chamber substantially homogeneously, such that said mixture is held by gases in the flame zone before and during the combustion of the fuel, and the mixture is thereby ionized prior to or during said combustion, and the ionized mixture of compounds contains about 10–20 micrograms of platinum, about 3–6 micrograms of rhodium, about 4–10 micrograms of rhenium, about 7–16 micrograms of molybdenum, about 10–20 micrograms of aluminum and about 3–6 micrograms of ruthenium per kilogram of fuel.

8. A method of improving fuel efficiency in combustion chambers for simultaneously enhancing combustion of hydrocarbon fuels while inhibiting nitrogen oxidation comprising introducing a mixture of vaporous metallic compounds via a vaporous transport into the flame zone of a combustion chamber substantially homogeneously, such that said mixture is held by gases in the flame zone before and during the combustion of the fuel, and the mixture is thereby ionized prior to or during said combustion, and the ionized mixture of compounds contains about 8–24 micrograms of platinum, about 2–8 micrograms of rhodium, about 3–10 micrograms of rhenium, about 6–18 micrograms of molybdenum, about 8–24 micrograms of aluminum and about 2–8 micrograms of ruthenium per kilogram of fuel.

9. A method of improving fuel efficiency in combustion chambers for simultaneously enhancing combustion of hydrocarbon fuels while inhibiting nitrogen oxidation comprising introducing a mixture of vaporous metallic compounds via a vaporous transport into the flame zone of a combustion chamber substantially homogeneously, such that said mixture is held by gases in the flame zone before and during the combustion of the fuel, and the mixture is thereby ionized prior to or during said combustion, and the ionized mixture of compounds contains about 8–24 parts of platinum, about 2–8 parts of rhodium, about 3–10 parts of rhenium, about 6–18 parts of molybdenum, and at least one of aluminum and ruthenium wherein the respective amounts of the aluminum and the ruthenium are about 8–24 parts of aluminum and about 2–8 parts of ruthenium, and wherein there is less than 225 micrograms of the platinum per kilogram of fuel.

10. A method of improving fuel efficiency in combustion chambers for simultaneously enhancing combustion of hydrocarbon fuels while inhibiting nitrogen oxidation comprising introducing a mixture of vaporous metallic compounds via a vaporous transport into the flame zone of a combustion chamber substantially homogeneously, such that said mixture is held by gases in the flame zone before and during the combustion of the fuel, and the mixture is thereby ionized prior to or during said combustion, and the ionized mixture of compounds contains about 0.15 to 225 micrograms of platinum, about from 0.045 to 67.5 micrograms of rhodium, about 0.07 to 105 micrograms of rhenium, about from 0.116 to 174 micrograms of molybdenum, about 0.15 to 225 micrograms of aluminum and about 0.045 to 67.5 micrograms of ruthenium per kilogram of fuel.

11. The method according to claim 10 wherein the amount of the aluminum in the mixture is in the range of 8–24 micrograms, and the amount of the ruthenium in the mixture is in the range of 2–8 micrograms.

* * * * *